US010524979B1

(12) United States Patent
Urso

(10) Patent No.: US 10,524,979 B1
(45) Date of Patent: Jan. 7, 2020

(54) SELF-RESCUE ANTI CHOKING IMPLEMENTS

(71) Applicant: Charles Louis Urso, Waltham, MA (US)

(72) Inventor: Charles Louis Urso, Waltham, MA (US)

( * ) Notice: Subject to any disclaimer, the term of this patent is extended or adjusted under 35 U.S.C. 154(b) by 0 days.

(21) Appl. No.: 16/350,131

(22) Filed: Oct. 1, 2018

Related U.S. Application Data

(60) Provisional application No. 62/708,358, filed on Dec. 6, 2017.

(51) Int. Cl.
*A61H 31/00* (2006.01)
*A61H 23/06* (2006.01)

(52) U.S. Cl.
CPC ..... *A61H 31/00* (2013.01); *A61H 23/06* (2013.01)

(58) Field of Classification Search
CPC ..... A61H 31/00; A61H 23/06
See application file for complete search history.

(56) References Cited

U.S. PATENT DOCUMENTS 1,091,310 A 3/1914 Dunn
4,059,099 A 11/1977 Davis
4,164,216 A 8/1979 Person
4,182,317 A 1/1980 Ash
5,722,987 A 3/1998 Witbeck
6,725,863 B2 4/2004 Karpel
2002/0156405 A1* 10/2002 Karpel ..... A61H 31/00 601/107
2008/0004551 A1 1/2008 Goodell
2008/0223376 A1 9/2008 Delaplane et al.
2012/0035515 A1* 2/2012 Ng ..... A61H 23/0254 601/107

* cited by examiner

*Primary Examiner* — Timothy A Stanis

(57) ABSTRACT

Each of seven shown and described embodiments of anti choking implements serves for both self-rescue and assisted rescue. A trekking staff embodiment (14) includes a thrust pad pack (16) supportable by a length-adjustable trekking staff (18) having an anti shock feature (22). The thrust pad pack is comprised of a series of nested selectable thrust pads (34, 36, and 38) differing in size and height relative to each other to suit the size and stature of a choking victim. Each thrust pad includes bilaterally adjustable elastomeric protuberances for abdominal thrusting bilaterally to avoid or minimize collateral compression of organs in the middle of the chest. Three table model embodiments (21, 100, and 150) are designed for use on household furniture. Among the table models is an embodiment having a pack (102) of detachably connected thrust pads (104, 106, and 108) differing in size and height. Three walking cane embodiments (60, 75, and 90) are shown and described wherein each can convert into an anti choking implement. Each cane embodiment includes a twin dome thrust pad pivotally supported to pivot from a storage position to a deployed position. The canes differ in the method of actuation, orientation, or position of the pivot mechanism.

15 Claims, 7 Drawing Sheets

SELF-RESCUE ANTI CHOKING IMPLEMENTS

CROSS-REFERENCE TO RELATED APPLICATIONS

The benefits of provisional patent application 62/708,358, filed 2017 Dec. 6 by the present inventor are claimed for this application.

BACKGROUND

Accidental choking in the U.S. ranks as the fourth greatest cause of accidental death. The National Safety Council reported that about 95 percent of these tragedies occur at the victim's home. Though anyone at any age could be a victim, being elderly increases the risk and the vast Baby Boomer generation is on the threshold of being at the higher risk age. The Heimlich maneuver of the 1970s is still among the first aid methods used, but all currently used methods of rescuing choking victims are controversial. One problem is that little is known about the reliability of the methods because reports about their success or failure are mainly anecdotal. Without solid evidence backing a best method of assisted rescue, authorities recommend a combination of methods; usually a combination of back blows and abdominal thrusts. Authoritative recommendations for self-rescue are even less definite.

What is generally advised is that a choking victim that can speak and breathe should be encouraged to cough as the best first aid. On the other hand, an individual with a totally blocked airway can't breathe, speak, or call anyone for help. If the latter victim is alone, some authorities advise self-actuated abdominal thrusts onto the backrest of a chair or on the edge of a countertop. But the chances of successfully dislodging a foreign object from the lone victim's airway would be far better if the abdominal thrusts are on an implement that is the right size and shape to efficiently compress the victim's lungs while avoiding injury. Logically, the right size depends on the victim's size, and the right shape should be determined by human anatomy and physiology for efficacy and safety. Moreover, a device for a victim to thrust on should be at a height that accommodates the victim's stature. And logic also suggests that a shock absorbing means is warranted for mediating the thrusts to minimize risk of injury. Finally, the implement must be easy for a layman to understand and use.

The patent records show some attempts to provide a life-saving device for a lone choking victim. Related references known to the present inventor and listed in a related Information Disclosure Statement show devices having a blunt thrust pad for thrusting medially against the victim's abdomen. But the victim's lungs are located laterally in the thorax, not medially. And medial thrusts could compress central thoracic organs against the bony ridge of the spine. Further, none of the prior art blunt thrust pads are sized according to the victim's size.

SUMMARY

Embodiments shown and described herein are of more practical anti choking implements. Each serves for self-rescue by a person having an airway completely blocked by food or other foreign object. The embodiments can also be efficiently used by an assistant to aid a choking victim. A first embodiment includes a plurality of thrust pads of a thrust pad pack supportable by a length-adjustable trekking staff having an anti shock feature. In a choking emergency, the combination serves as an anti choking implement at home or in remote settings—indoors or outdoors. The thrust pad pack is comprised of a series of nested thrust pads differing in size and height relative to each other and each thrust pad is selectable to best accommodate the size and stature of the victim. Each thrust pad includes a pair of bilateral elastomeric protuberances for compressing each of a choking victim's lungs, respectively, and to minimize collateral compression of organs in the middle of the chest. Each thrust pad protuberance for a particular pad size is predetermined to be approximately the size of a potential choking victim's fist.

Three table model embodiments also serve for self-rescue or to assist a choking victim. These include a pack of thrust pads that vary in size and height and are supported by a base for resting on a dinner table, desk, or other common furniture. Bilateral handles are attached to the base for use by a lone choking victim or by an assistant. Two of the table models have means for adjusting the position of bilateral protuberances relative to each other.

Three walking cane embodiments are also shown and described wherein each can convert into an anti choking implement. Each cane embodiment includes customary cane features of a length-adjustable staff and handle, but also includes a thrust pad pivotally supported to pivot from a storage position to a deployed position. In the deployed position, the combination facilitates self-rescue of a choking victim. The cane embodiments differ in the method of actuation and/or the position or orientation of the pivot mechanism.

Advantages

Each nested thrust pad of the thrust pad pack differs in size and height for self-rescue or for assisting rescue of a victim according to the victim's size and stature. And each thrust pad is quickly accessible for self-use. All of the embodiments are especially needed safety devices for people that live alone.

Three of the embodiments are small compact table models and are versatile for use by a rescuer of a choking victim or for self-rescue. Elastomeric protuberances are arranged for being directed bilaterally of the abdomen to compress both lungs simultaneously. The bilateral compression method is more likely to expel a foreign object than by the conventional central (medial) compression method. The logic is that abdominal compression directed bilaterally toward the lungs is more efficacious and avoids or minimizes collateral compression of vital organs in the middle of the chest.

The walking cane embodiments are advantageous for elderly people because they are at greater risk for choking and are more likely to have access to a cane to facilitate walking. Each cane embodiment serves for dealing with a choking emergency at home or when remotely away from home.

DRAWINGS—FIGS. 1-14

The accompanying drawings in combination with the description herewith illustrate features of embodiments. Like reference numerals refer to the same parts. The drawings are not necessarily to scale.

DETAILED DESCRIPTION

First Embodiment or Trekking Staff Model—FIGS. 1, 2A, 2B, 3, and 5

Figure 1:
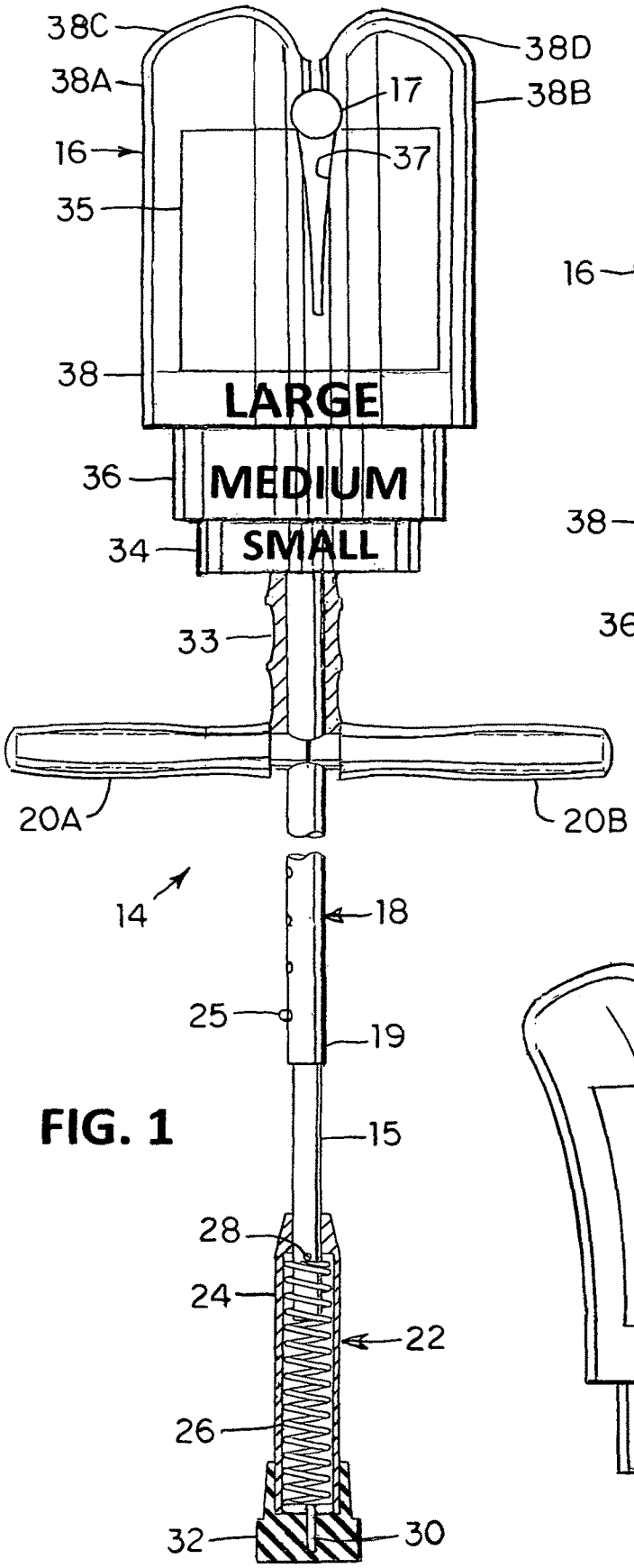
FIG. 1 is a front side view of a first embodiment or trekking staff model of an anti choking implement including a thrust pad pack of bilaterally adjustable thrust pads wherein an axial handle and shock absorber are in section and a mid portion of the staff is cut away.

FIG. 1 shows a front side view of a first embodiment of an anti choking implement 14. This indoor/outdoor model includes a thrust pad pack 16 detachably connected to a trekking staff 18 that is adjustable in length. Ancillary features of staff 18 include bilateral cross handles 20A and 20B for controlling the implement, and a shock absorber 22 for mediating impacts. The ancillary features and other features explained below enhance the benefits of staff 18 in the sport of trekking. Moreover, the ancillary features enhance implementation of anti choking implement 14 during a choking emergency indoors, outdoors, and in remote locations. Thrust pad pack 16 would normally be detached from staff 18 when the later is used for sauntering or trekking, but is be attached at all other times.

Trekking Staff

Staff 18 includes an outer aluminum tube 19 and an inner aluminum tube 15 slidably supported in tube 19 in order to telescope, thereby enabling staff 18 to be adjustable in length. A conventional telescope locking means is provided including a locking button 25. The button is spring-urged to pass through a user-selected hole of a row of selectable holes along outer tube 19. Thus, button 25 locks the staff at a selectable length. In a choking emergency, a lower end portion of staff 18 serves for being placed adjacent whatever surface a choking user stands on. Bilateral cross handles 20A and 20B include soft elastomeric cushions enclosing short aluminum tubes, respectively. The aluminum tube in each handle has a concave end portion welded to tube 19. An axial handle 33 includes a soft elastomeric cushion surrounding tube 19 wherein handle 33 perpendicularly adjoins cross handles 20A and 20B for benefits explained in the "Operation of the First Embodiment" section below.

Shock absorber 22 includes an elongate aluminum housing 24 enclosing a helical compression spring 26. A bottom end of housing 24 is capped by an aluminum cap welded thereon to retain spring 26. A carbide spike 30 threadedly mated to a threaded aperture in the cap projects distally of shock absorber 22 for gripping rough terrain. A detachably connectable rubber tip 32, molded to cover a bottom end portion of shock absorber 22 and its carbide spike 30, serves for gripping paved surfaces. An upper end portion of housing 24 defines a concentric aperture that receives tube 15 for sliding longitudinally within housing 24. A stop pin 28 passes through tube 15 and rests on spring 26. Thus, when implement 14 is upright, spring 26 movably supports all the weight of implement 14 above shock absorber 22 plus any user weight imposed on implement 14.

A snow web called a snow basket (not shown) may be detachably connected to the distal end of shock absorber 22 to prevent or minimize sinking in mud or snow.

Thrust Pad Pack

Thrust pad pack 16 is intended for attachment to an upper end portion of staff 18 when the staff is not being used for trekking. Being comprised of a plurality or series of thrust pads, pad pack 16 includes a first blunt thrust pad 34, a second blunt thrust pad 36, and a third blunt thrust pad 38. Second pad 36 is generally bigger and taller than pad 34 and is detachably connectable to pad 34. Pad 36 extends axially beyond pad 34 when connected thereto. Thus, pad 36 serves a bigger and taller user (choking victim) than one intended for being served by pad 34. Third thrust pad 38 is generally bigger and taller than pad 36 and is detachably connectable to pad 36. Pad 38 extends axially beyond pad 36 when connected thereto. Thus, pad 38 serves a bigger and taller user than one intended for being served by pad 36.

Figure 5:
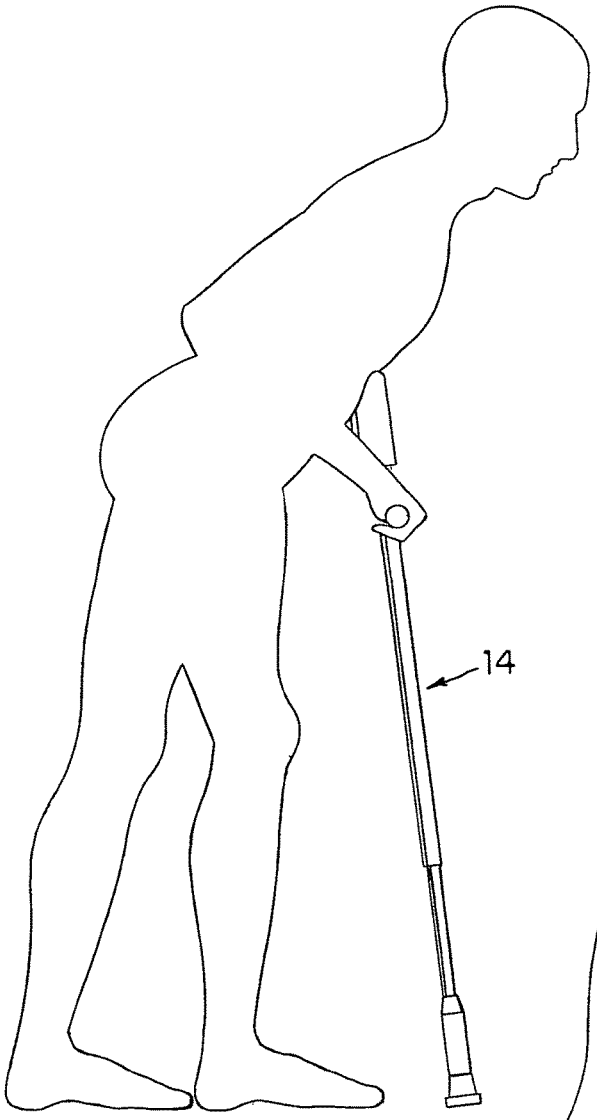
FIG. 5 is a lateral side view of the trekking staff model of the anti choking implement of FIG. 1 showing the implement positioned for self-rescue by a choking user.

A label 35 is adhered to each pad for displaying a diagram similar to FIG. 5 to remind a potential lone user of implement 14 how this implement is used in a choking emergency. The words "SMALL," "MEDIUM," and "LARGE" in FIG. 1 are boldly printed on the thrust pads, respectively, to immediately identify the right thrust pad to use according to a potential user's physical size. Some letters of each word are stretched laterally to compensate for distortion caused by concave curvature of each thrust pad. A complete usage explanation is in the "Operation of the First Embodiment" section below.

Figure 2A:
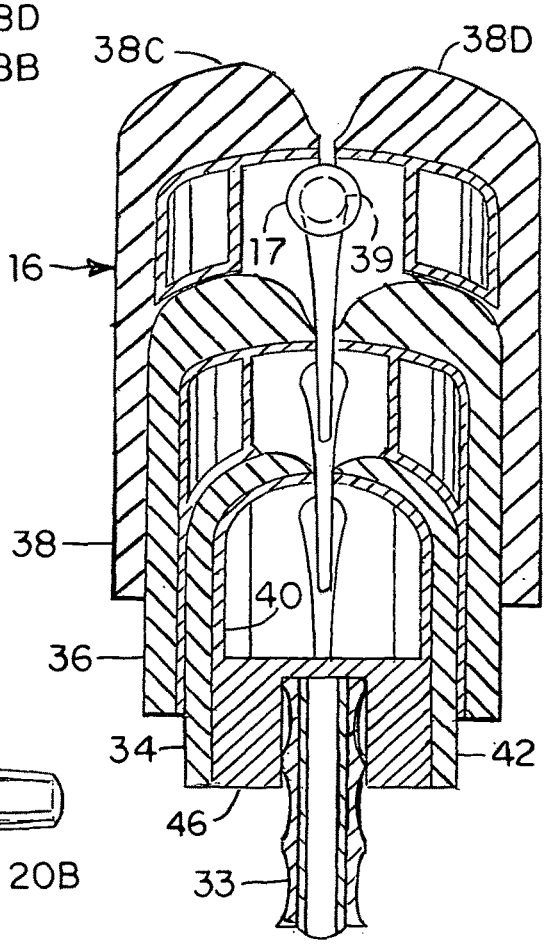
FIG. 2A is a sectional view taken through a longitudinal midline of the thrust pad pack wherein the pad pack is detachably connected to the axial handle of the trekking staff of FIG. 1.

FIG. 2A shows pad pack 16 in cross-section taken alone the longitudinal axis thereof. First thrust pad 34 includes an arched resilient plastic frame 40 supporting a moderately soft elastomer cushion 42 fixedly glued onto frame 40. Cushion 42 is molded to fit the external arched contours of frame 40. The latter includes a mounting flange 46 having a cavity that detachably receives an end portion of handle 33 tightly therein to attach pad pack 16 onto staff 18.

As mentioned, pad 36 is larger than pad 34 and pad 38 is larger than pad 36, but all are interiorly hollow and structurally similar to pad 34 except that the two largest pads have no mounting flange. Second pad 36 and third pad 38 detachably receive a preceding smaller pad by snugly enclosing the preceding smaller pad and detachably adhering thereto by slight compression of the resilient cushion of the preceding smaller pad.

The Size and Shape of the Thrust Pads Matter

The human diaphragm is muscular and shaped like a pair of hollow juxtaposed domes when relaxed. When contracting, the diaphragm tends to flatten. When relaxing, the diaphragm moves upward to enable the lungs to expel their contained gases. The two dome-like portions of the diaphragm fit conformingly under concave bottom sides of the two lungs, respectively. Therefore, to be efficient, a thrust pad must be of a size and shape that will press upper abdominal tissues bilaterally and expeditiously against the underside of the diaphragm.

FIGS. 1 and 2A show that pad 38 defines an elongate funnel-shaped slot 37 having a long length and a progressively narrowing width equally dividing a pair of lobes 38A and 38B from each other. Each of the three thrust pads have a pair of lobes divided from each other by a similar funnel-shaped elongate slot. The top side of thrust pad 38 includes a pair of bilateral dome-shaped protuberances 38C and 38D extending from the two lobes, respectively, and divided from each other by slot 37. Pads 36 and 34 have pairs of protuberances similar in shape to those of pad 38, but differ in size. Each protuberance of a particular pad size is predetermined to be approximately the size of a potential choking victim's fist.

Figure 2B:
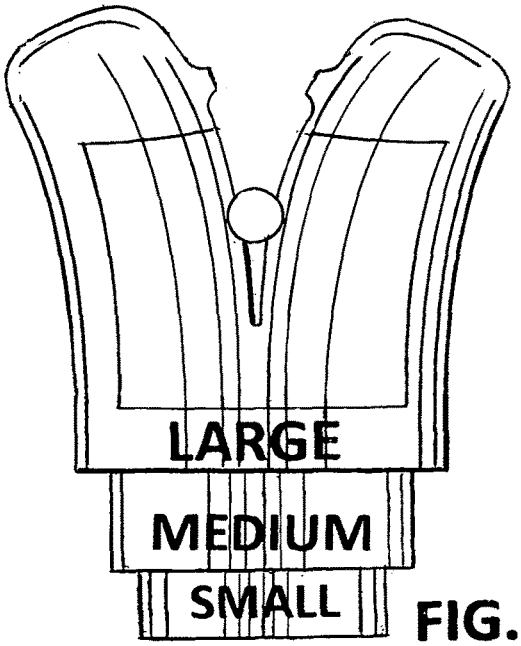
FIG. 2B shows the outermost thrust pad of the pad pack of FIG. 1 adjusted for wider bilateral application.
Figure 3:
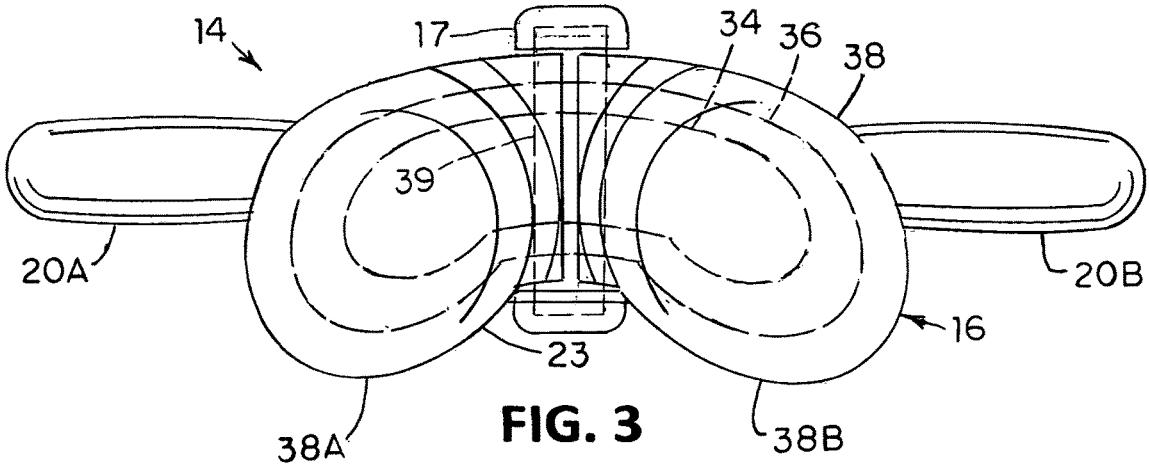
FIG. 3 is a top view of the trekking staff model of FIG. 1 showing that each thrust pad of the pad pack has bilateral protuberances for conforming with the concave bilateral undersides of the human diaphragm that are directly under the lungs, respectively.

An adjuster 17 comprised of an elongate plastic cylinder having circular knobbed end portions 39 is normally stored in an upper end portion of the funnel-shaped slot. The cylindrical portion of adjuster 17 is wider in diameter than most of the slot width. Thus, by pushing the adjuster to move progressively downward within and along slot 37, the lobes and their protuberances move progressively further apart as indicated in FIG. 2B. As shown in FIG. 3, the knobbed end portions of adjuster 17 extend from opposite sides of pad 38 to enable a user to position the protuberances in alignment with a potential choking victim's lungs, respectively. The position of the protuberances is determined by the chest size of a potential choking victim. Pads 34 and 36 are each capable of receiving adjuster 17 through the open end of their funnel-shaped slot when adjustment of their protuberances is warranted.

FIG. 3, in a top view, shows that thrust pad 38 includes a concave edge portion 23 shared by the two symmetrical, bilateral, and rounded pad lobes 38A and 38B. The lobe protuberances are spaced from each other and facing approximately in parallel directions. Thus, when the thrust pad bilaterally engages the abdomen of the choking victim, the two protuberances can be directed toward the victim's two lungs, respectively. By compressing the abdomen inwardly and upwardly, the pressure of the protuberances is transmitted through the soft abdominal tissues and diaphragm to compress the lungs, respectively.

Hence, the thrust pads are configured for efficient expulsion of lung gases from both lungs for dislodging the foreign object causing the choking. And each thrust pad of pad pack 16 differs in size and height or tallness relative to the other thrust pads to rescue individuals according to their physical size and stature.

Operation of the First Embodiment

Pad pack 16 is detached from staff 18 when the latter is used for trekking. When trekking, staff 18 not only provides balance on rough terrain but also lessens weight on the user's legs. The result is less leg fatigue, faster traveling, and more endurance. The cross handles and axial handle combination enables a variety of gripping options so the user can frequently change the way he or she grips the staff. This prevents or minimizes fatigue on muscles of the hand and forearm.

Being mostly hollow, the thrust pad pack is light-weight and may be carried in the user's back pack. Mealtime, however, poses a choking risk, especially for those that are middle-aged or older and/or wear dentures. Thus, the pad pack should be attached to the trekking staff before meals begin.

Ninety-five percent of choking tragedies occur in homes. Therefore, all household members should know how to use the implement from printed instructions provided with the purchase. Implement 14 ought to be stored, ready to use, in a broom closet or other convenient place in or near the kitchen or dining room. No time should be wasted to make length adjustments to the staff during an actual choking emergency. Therefore, the length of the staff should be preset for rescuing the shortest potential user in the household that might be home alone at the time of such an emergency. Taller users will have taller thrust pads to use. A small user will be best served by the SMALL thrust pad which is shorter in height than the other thrust pads.

A medium size user will use the MEDIUM thrust pad molded to be higher (taller) than the previous one; and a large user will use the LARGE thrust pad which is molded to be higher (taller) than the previous pad. To be more precise, the width of the outermost thrust pad may be preset with adjuster 17 if warranted by the chest size of the largest potential user in the household. Printed Instructions will be provided to explain how to pre-adjust the thrust pad using adjuster 17 accordingly.

In an emergency, a lone user can use implement 14 as shown in FIG. 5. If necessary, the user can pull off any larger thrust pad(s) not appropriate for the user's size. The bottom portion of the staff should rest on the ground or floor. The top side of the appropriate thrust pad (concave edge toward the user) should be positioned to engage the user's abdomen just above the user's navel. With hands on the cross handles to steady the implement, the user can repeatedly thrust the user's abdomen downward while engaging the top of the thrust pad bilaterally until the upward force of the thrust pad causes expulsion of gases from the user's lungs to dislodge whatever causes the choking. During the thrusting actions, the shock absorber helps to mediate the thrust impacts. The void between properly adjusted protuberances serves to reduce or avoid direct pressure on vital organs in the middle of the chest.

In another scenario, if an assistant is available and a conscious choking victim wants help, the assistant can use the implement to do the thrusting. The assistant can position himself or herself behind the victim while gripping both cross-handles. The assistant can then place the top of the appropriate size pad (concave edge toward the victim) just above the victim's navel and apply pad thrusts bilaterally of the abdomen at an upward angle toward the victim's lungs.

Second Embodiment: A Table or Portable Model A—FIGS. 4 and 6

Figure 4:
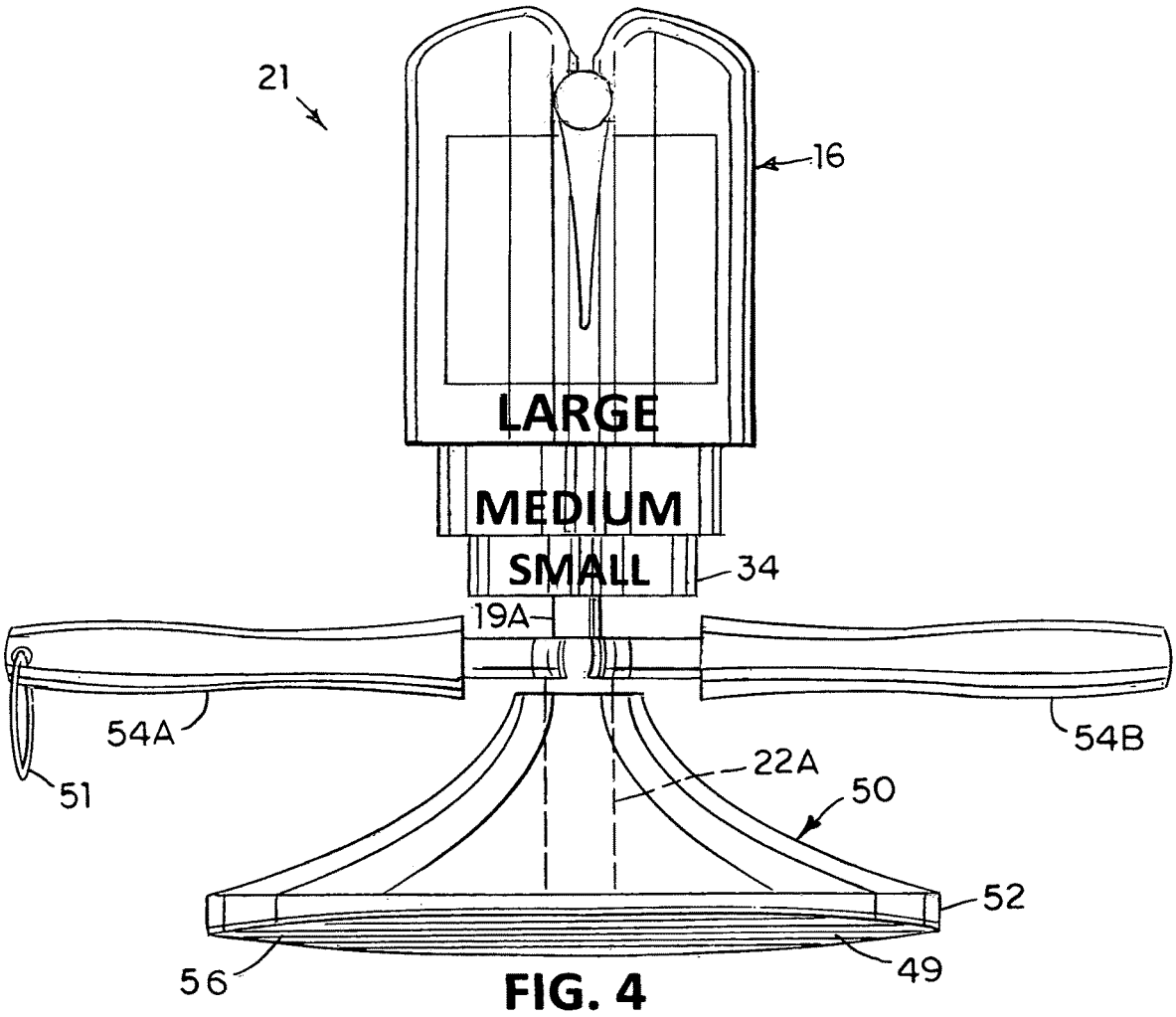
FIG. 4 is front side view of a second embodiment or table model A of an anti choking implement using the same thrust pad pack as the first embodiment.
Figure 6:
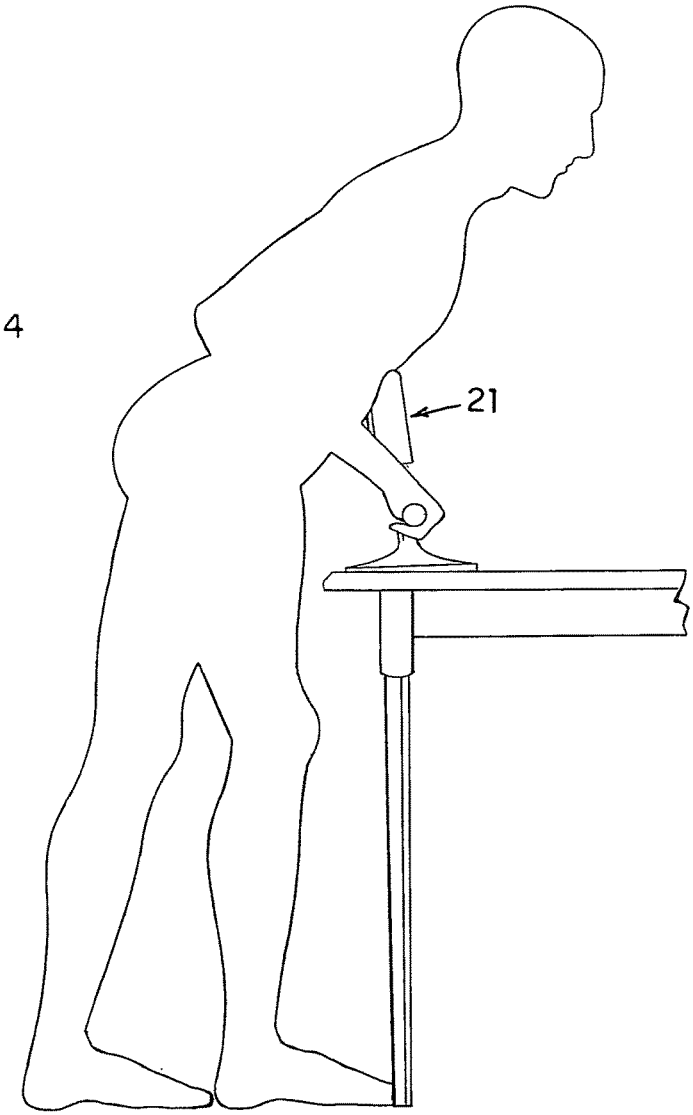
FIG. 6 is a lateral side view of table model A of the anti choking implement of FIG. 4 showing the implement positioned on a tabletop for self-rescue by a choking user.

FIGS. 4 and 6 show a second embodiment of an anti choking implement 21 that includes the same thrust pad pack 16 as explained above. Pad pack 16 is supported on a short plastic base 50 that includes a bottom portion that forms an oval flange 52. Base 50 supports pad pack 16 in an operative upright position. And base 50 defines an axially concentric aperture that fixedly contains a shock absorber 22A similar in construction to shock absorber 22, but is shorter and its aluminum housing is exteriorly cylindrical from top to bottom. Shock absorber 22A receives a lower end portion of a tube 19A for sliding longitudinally therein and tube 19A is supported on a compression spring (not shown) in the same manner as tube 15 of the first embodiment. Tube 19A also includes an upper end portion (not shown) extending upward into thrust pad 34 and adapted to be detachably connected therein in the same manner as tube 19 of the first embodiment. As arranged, the spring in shock absorber 22A movably supports all the user weight imposed on any of the thrust pads of pad pack 16.

Bilateral cross handles 54A and 54B include soft elastomeric cushions surrounding aluminum tubes having concave end portions welded to the housing of shock absorber 22A. A ring 51, attached by conventional swivel means to cross handle 54A, serves for hang-storing implement 21. Flange 52 of base 50 includes a bottom face 56 for interfacing with whatever surface implement 21 rests on. For slip resistance, face 56 is the bottom surface of a soft rubber pad 49 that defines an array of parallel linear grooves to enhance slip resistance. Pad 49 is adhered with glue to form a bottom portion of flange 52. The latter is angled such that all thrust pads of pad pack 16 tilt at a few degrees from vertical to be in operative upright positions. As indicated in FIG. 6, the tilt serves for tilting slightly toward a choking user to facilitate thrusting the user's abdomen on a selected thrust pad to dislodge whatever is causing the choking. Operation of the second embodiment is explained after the description of a third embodiment below. Each has unique features, but both operate in similar ways.

Third Embodiment: A Table or Portable Model B—FIGS. 7 and 8

Figure 7:
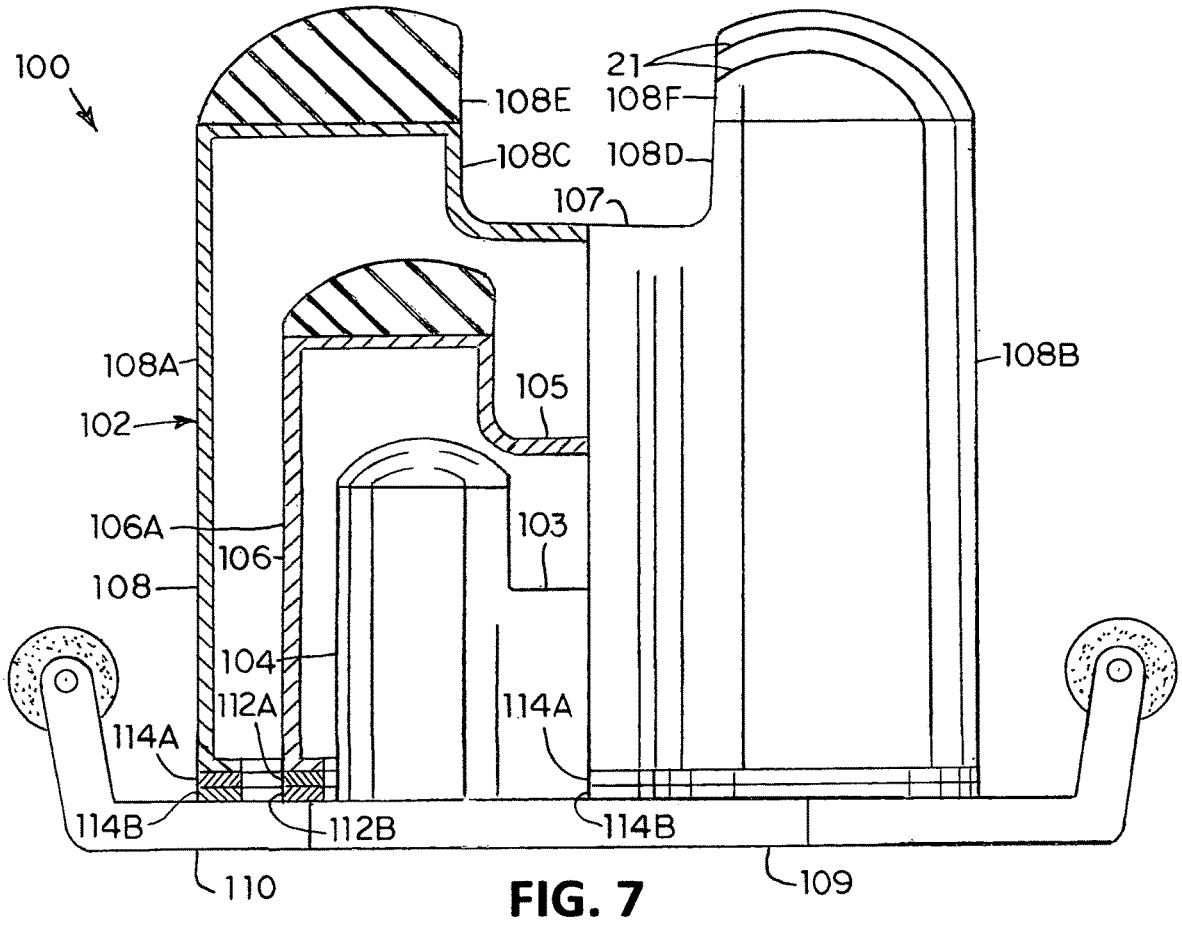
FIG. 7 is a front side view of a third embodiment or table model B of an anti choking implement shown partly in section taken through a longitudinal axis of a lobe thereof.
Figure 8:
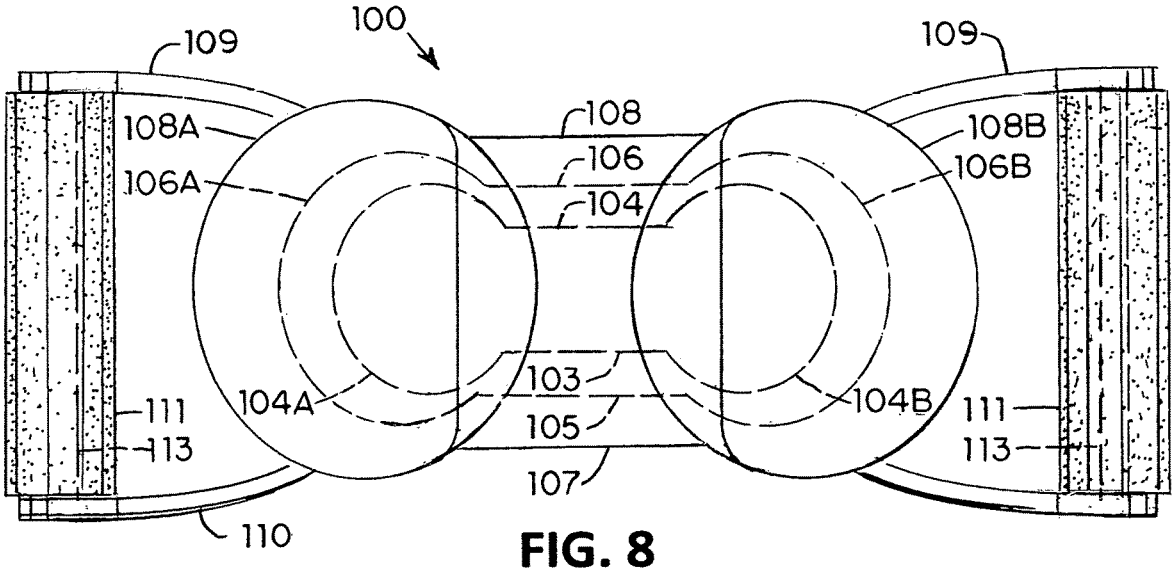
FIG. 8 is a top view of the anti choking implement of FIG. 7.

FIGS. 7 and 8 show a third embodiment of an anti choking implement 100 similar in principle to implement 21. A pad pack 102 includes a plurality of hollow thrust pads arranged as a nested series. The series includes a first or small blunt thrust pad 104, a second or medium blunt thrust pad 106, and a third or large blunt thrust pad 108.

Pad 108 includes two symmetrical bilateral lobes 108A and 108B having partially rounded protuberances 108C and 108D, respectively, that are spaced from each other and facing approximately in parallel directions for compressing the victim's two lungs, respectively. Lobes 108A and 108B and their protuberances are fixedly connected by an integrally molded bridge 107. The pad lobes are interiorly hollow and mostly oval or elliptical-shaped in horizontal cross-section. Dome-shaped elastomer cushions 108E and 108F form moderately soft cap portions of the protuberances, respectively. Grooves 21 traverse the caps to enhance slip resistance on an abdomen. Aside from the cushioned caps, the walls of the pad are comprised of semi-rigid thermoplastic. The major elliptical axes of horizon cross-sections of lobes 108A and 108B are parallel to each other.

The two dome-shaped and spaced protuberances conform to the concave undersides of the human diaphragm end portions, respectively, under human lungs. Each pad protuberance profile, in a top view thereof, is shaped approximately like the moon-phase shape of human lung cross-sections. The rounded side of each thrust pad protuberance faces laterally of the thrust pad, just as the rounded side of each human lung faces laterally in the thorax (chest). Hence, the protuberances are shaped to maximize efficiency in expulsion of lung gases when compressing the underside of the lungs.

Thrust pad 104 and thrust pad 106 are structured like pad 108 but are smaller wherein the two hollow lobes 106A and 106B of pad 106 are detachably received and nested within the two hollow lobes of pad 108, respectively. Both lobes of pad 106 are fixedly connected by an integrally molded bridge 105. Both lobes 104A and 104B of pad 104 are detachably received and nested within the hollow lobes of pad 106, respectively, wherein the two lobes of pad 104 are fixedly connected by an integrally molded bridge 103. Second pad 106 is generally bigger and taller than pad 104 and is detachably connectable to pad 104 by mutual attraction of a pair of permanently magnetic gaskets 112A and 112B. Gasket 112A is fixedly glued to the bottom edge of pad 106 and gasket 112B is fixedly glued to a rigid plastic molded base 109. Pad 106 serves a bigger and taller user or choking victim than one intended for being served by pad 104. Third thrust pad 108 is generally bigger and taller than pad 106 and is detachably connectable to pad 106 by mutual attraction of a pair of permanently magnetic gaskets 114A and 114B. Gasket 114A is fixedly glued to the bottom edge of pad 108 and the gasket 114B is fixedly glued to base 109. Pad 108 serves a bigger and taller user than one intended for being served by pad 106. Reminder labels (not shown) showing how implement 100 is used are adhered to the thrust pads, respectively, in the same manner as described above for the first two embodiments.

Pad 104 is fixedly attached to base 109. The latter includes two pairs of handle brackets 110 integrally molded to form opposite end portions of base 109, respectively. The bracket pairs fixedly support soft rubber handles 111, respectively, by means of metal shafts 113 that pass through apertures in the brackets and handles. Handles 111 are parallel to each other. Except for the handles and brackets, base 109 and pad 108 have identical profiles in the top view of implement 100 (FIG. 8).

In addition to the elastomer cushions, air trapped in the pads by the magnetic gaskets also helps to cushion thrusting as the thrust pads resiliently yield a bit vertically by puffing out a bit laterally during thrusting. The magnetic attraction of the gaskets can be overcome by a choking victim or an assistant thereof if one or two thrust pads must be lifted off of implement 100 during an emergency.

Operation of the Second and Third Embodiments

Anti chocking implement 21 or 100 can be used while resting on a tabletop for self-rescue of a choking victim or as a compact portable model for use by a rescue assistant of a choking victim in a modified Heimlich maneuver.

In a choking emergency when the victim is alone, implement 21 or 100 can be supported on a desk, chair armrest, end table, or kitchen tabletop as in FIG. 6. The implement can be immediately utilized as described for implement 14, but without the staff. The void between protuberances serves to reduce or avoid direct pressure on organs in the middle of the chest.

If an available assistant is familiar with the use of the implement and a choking victim wants help from the assistant, the assistant can position himself or herself behind the victim while gripping a handle in each hand, respectively. The assistant can then place the top of the pad of the appropriate size just above the victim's navel and apply pad thrusts at an upward angle toward the victim's lungs. If the victim is a swimmer that inhaled water, the assistant (such as a life guard) would be positioned in front of the reclined victim.

Fourth Embodiment: A Table or Portable Model C—FIGS. 9A, 9B, and 9C

Figure 9A:
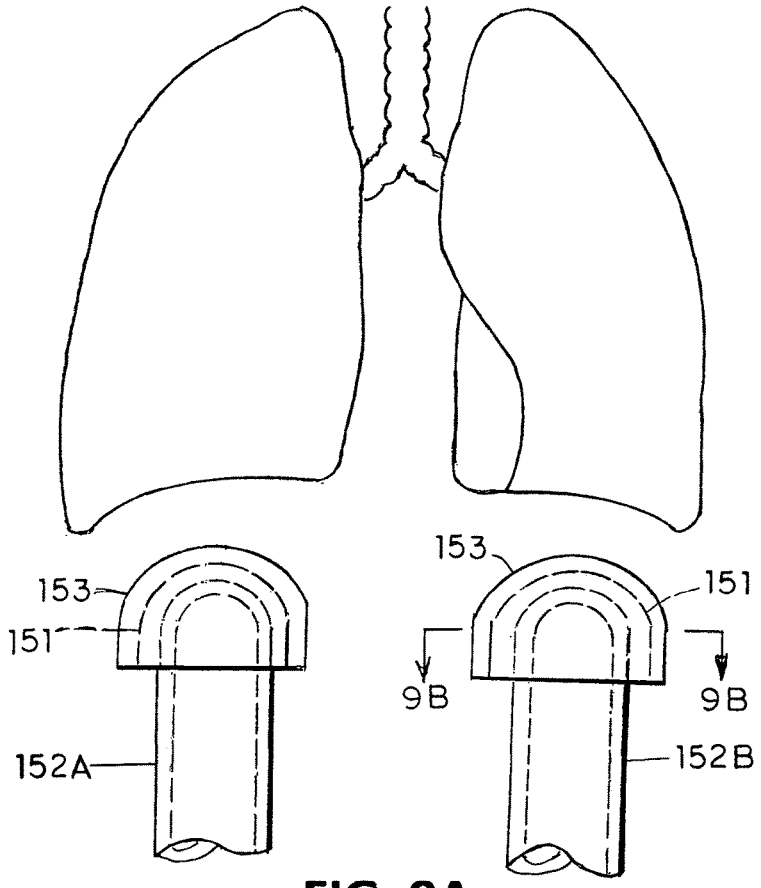
FIG. 9A is a fragmental side view of a fourth embodiment or table model C of an anti choking implement indicating nested caps of various sizes for selectively adjusting the size of protuberances for thrusting toward a choking victim's lungs.
Figure 9B:
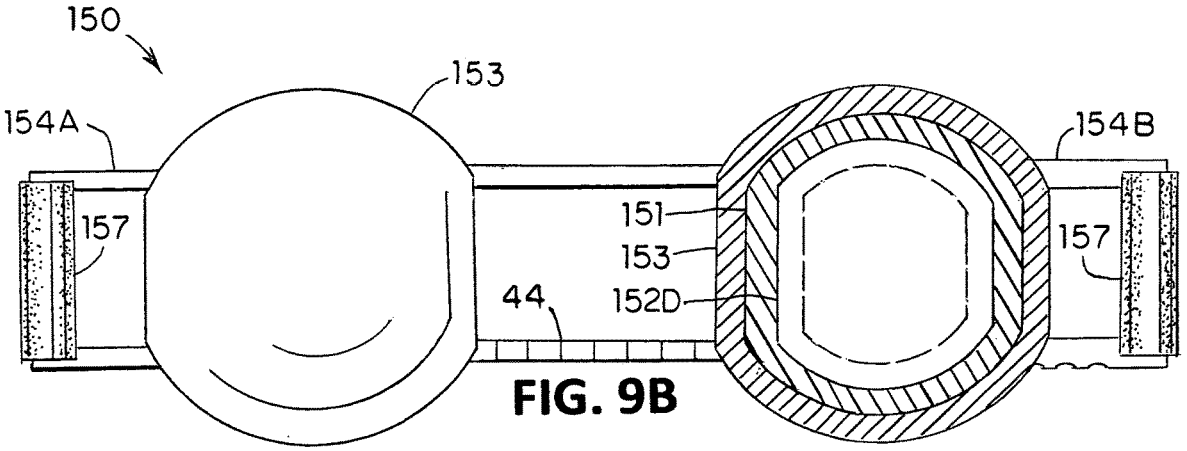
FIG. 9B is a top view, partly in section, of the embodiment of FIG. 9A including a laterally adjustable base portion enabling lateral adjustment of the nested caps according to the user's chest size.
Figure 9C:
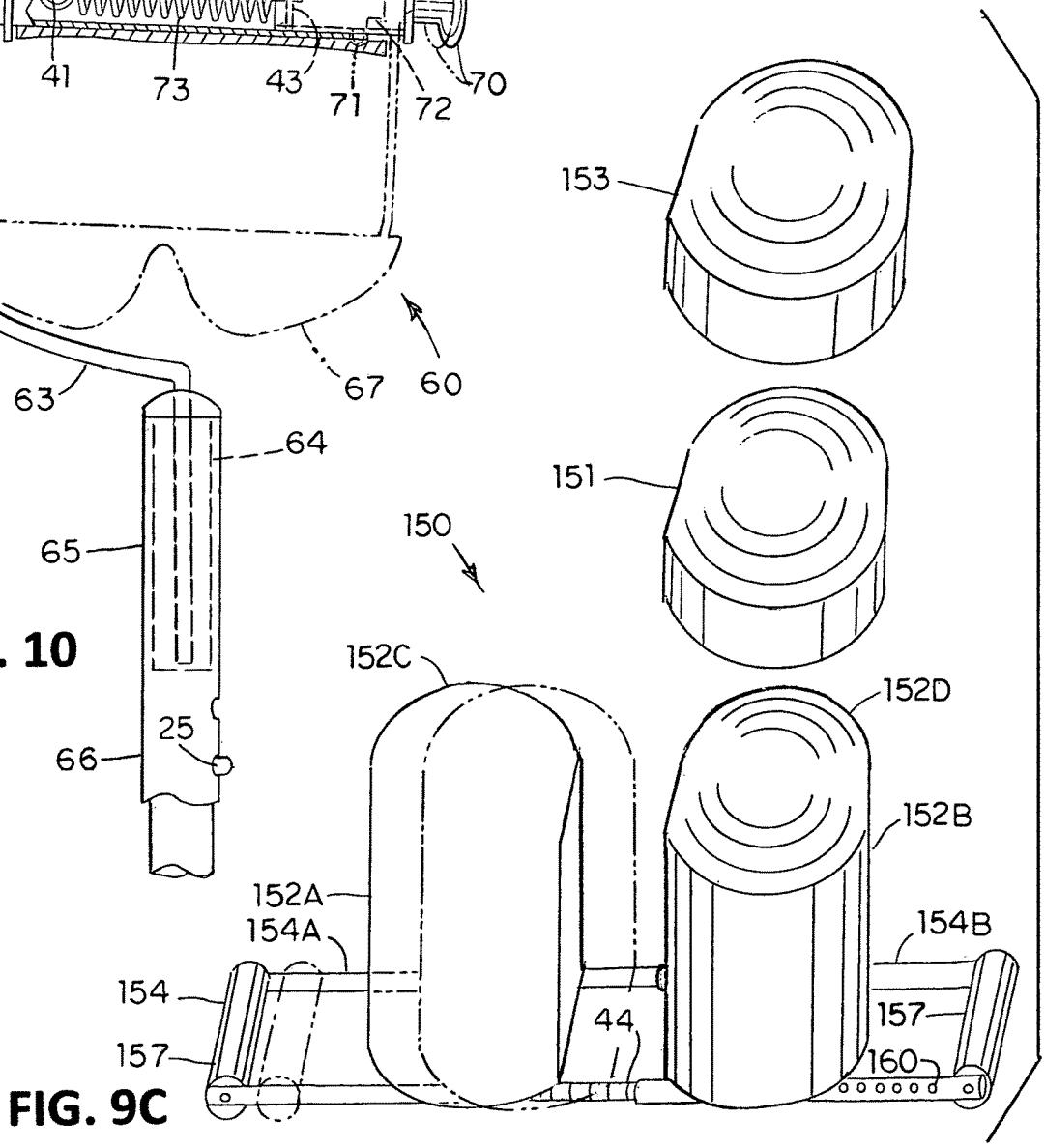
FIG. 9C is a perspective exploded view of the anti choking implement of FIG. 9B showing the nested caps of various sizes and showing the base for adjusting the positions of the protuberances relative to each other according the chest size of a potential user.

FIGS. 9A, 9B, and 9C show a fourth embodiment of an anti choking thrust pad or implement 150. Best shown in FIG. 9C is a pair of spaced symmetrical bilateral pad lobes 152A and 152B having partially rounded protuberances 152C and 152D, respectively. (Lobe 152A has no shade lines to avoid confusion with its phantom image.) The two protuberances are spaced from each other and face approximately in parallel directions for compressing a choking victim's two lungs, respectively. Each lobe is a hollow sealed enclosure walled on all sides and its walls are molded semi-rigid thermoplastic. The profile of each protuberance, in a top view thereof, is shaped approximately like the moon-phase shape of human lung cross-sections. The rounded side of each protuberance faces laterally of the implement, just as the rounded side of each human lung faces laterally in the thorax. The two spaced protuberances are dome-shaped to conform to the concave undersides of the human diaphragm end portions, respectively. Both lobes 152A and 1526 are pressurized with compressed air by conventional means to help in cushioning thrusts.

The two lobes are fixed with adhesive to oppositely movable sections 154A and 154B, respectively, of an elongate length-adjustable base 154 such that the lobes are movable relative to each other. Base 154 is comprised of a pair of spaced parallel telescoping tube sets arranged such that the narrowest diameter tubes support lobe 152A and widest diameter tubes support lobe 152B. Thus, when the tube sets telescope, the lobes move relative to each other for aligning the protuberances with a potential choking victim's lungs, respectively. Two handles 157 are fixed between the tube sets at opposite end portions of base 154, respectively, to enable implement 150 to be handled and controlled by a choking victim or by an assistant.

Protuberances 152C and 1520 form permanent caps for thrusting the abdomen of a relatively small choking victim. For serving bigger victims, the protuberances have larger detachable ancillary caps or protuberances that fit on top of the permanent caps. As indicated in the figures, protuberance 152D is normally detachably capped by a medium-size moderately soft elastomer protuberance or cap 151. The latter is shaped like a hollow dome and fits over and around the smaller protuberance to serve a medium-size user. From a top view, cap 151 is moon-phase shaped like human lung cross sections. And cap 151 is normally detachably capped by a large-size moderately soft elastomer protuberance or cap 153. The latter is shaped like a hollow dome and fits over and around cap 151 to serve a large-size user. From a top view, cap 153 is moon-phase shaped like human lung cross sections. Duplicates of caps 151 and 153 normally cover protuberance 152C in the same order as those covering protuberance 152D. Thus, the permanent caps and the detachable caps combined with the lobes form three nested selectable thrust pads for rescuing small-size, medium-size, or large-size victims, respectively. Removal of one or more detachable caps may be preferred according to the size of the choking victim.

Base section 154A includes a calibrated scale 44 (scale numbering not shown) and base 154 includes a spring-button lock set 160 (FIG. 9C) similar to the lock set described for implement 14. Scale 44 has predetermined measuring marks for adjusting the spatial distances between the pad protuberances according to chest sizes of potential choking victims for accurate alignment of the protuberances with a choking victim's lungs, respectively. Lock set 160 can also be used to lock implement 150 at a customized setting so the implement is always ready for immediate use by a particular user. Having large spring buttons and large corresponding buttonholes enable quick base adjustments to suit users that differ in size.

Figure 10:
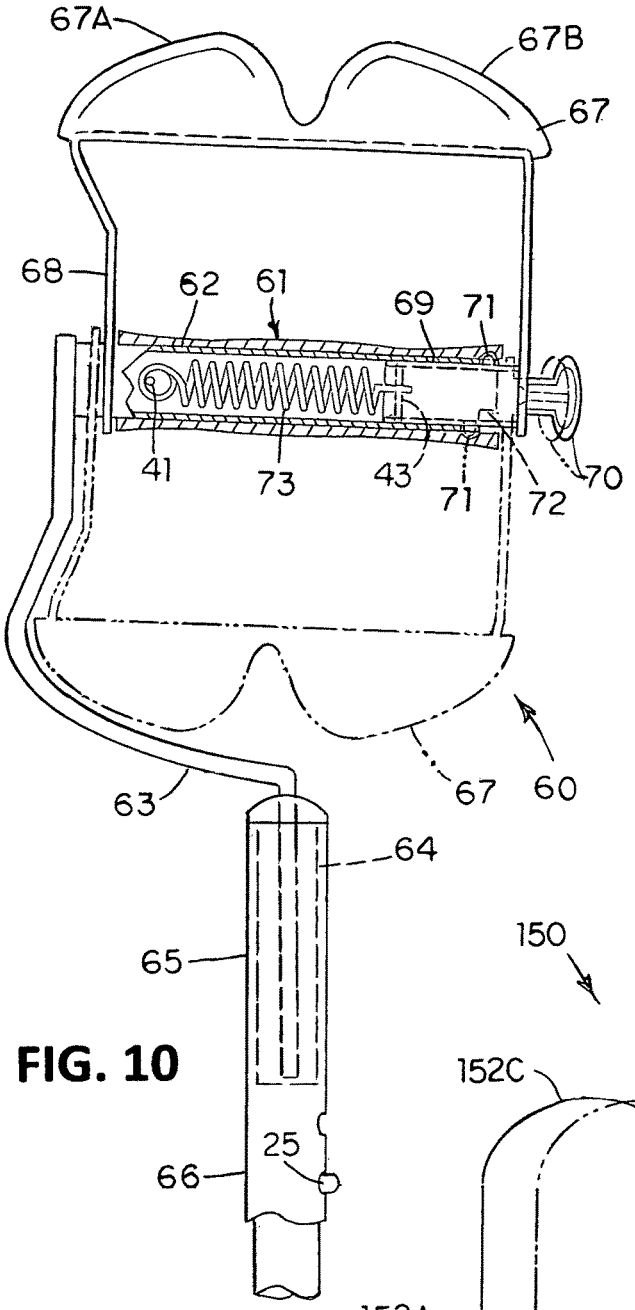
FIG. 10 is a lateral side view of a fifth embodiment or cane model A of an anti choking implement wherein the cane handle is shown in section and a pivotally supported thrust pad is indicated in a stored position (phantom image) and solidly shown in a deployed position.
Figure 11:
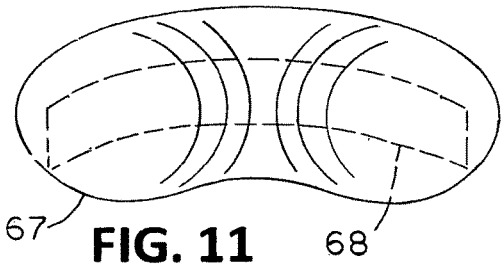
FIG. 11 is a top view of the bilateral thrust pad of cane model A of FIG. 10.

Fifth Embodiment or Cane Model A—FIGS. 10 and 11

Elderly people are at increased risk of choking and many elderly people use a walking cane. Hence, FIGS. 10 and 11 show a fifth embodiment or a cane model A designed to instantly convert to an anti choking implement 60. This embodiment includes a cane handle 61 comprised of a short aluminum tube 62 covered by a foam cushion. Tube 62 has an end portion welded to an aluminum bar bent to form a frame 63. A stem portion of frame 63 is securely imbedded in a molded plastic cap 64 which is tightly received in an end portion of an outer tube 66 of a conventional multi-tubular telescoping cane staff 65. A conventional telescope locking means is provided including a lock button 25. The locking means works as described for implement 14.

An elastomeric thrust pad 67 is supported on a U-shaped frame 68 formed by bending an aluminum bar. Thrust pad 67 includes protuberances 67A and 67B spaced from each other and facing in approximately parallel directions. An intermediate portion of frame 68 is fixedly imbedded in pad 67. An end portion of frame 68 is welded to the end of a mini-pipe 69 which is slidably and rotatably supported in tube 62. An opposite end portion of frame 68 defines an aperture receiving tube 62 so that frame 68 is slidably and rotatably supported on tube 62. A pull handle 70 is attached by a machine screw to frame 68.

A tab 71 projects radially from the outer surface of mini-pipe 69 and is receivable in a narrow longitudinal open-ended slot in a distal end portion of tube 62 to retain pad 67 in a stored position. The phantom image of FIG. 10 indicates the stored position of pad 67. A stop lug 72 extends from a distal circumferential edge portion of tube 62 wherein a stop edge of lug 72 extends longitudinally of tube 62 and is positioned 180 degrees from the open-ended slot. A helical torsion spring 73, also serving as a pull spring, includes an end portion connected to a pin 41 passing through tube 62. An opposite end of spring 73 is connected under spring tension to a pin 43 passing through mini-pipe 69. As arranged, spring 73 pulls on frame 68 and mini-pipe 69 to urge tab 71 to stay in the open-ended slot of tube 62 when pad 67 is in the stored position. Spring 73 is also under torsion tension to urge frame 68 to pivot clockwise, as viewed from the pull handle side of frame 68. Thus, when pad 67 is in the stored position and a user pulls handle 70, tab 71 will be pulled out of the open-ended slot wherein frame 68 and thrust pad 67 will be spring-driven to pivot 180 degrees and will stop when tab 71 reaches stop lug 72. Thrust pad 67 will then be in a deployed position inches above and beyond cane handle 61 as indicated by the solid line image of pad 67 in FIG. 10.

FIG. 11 shows a top view of thrust pad 67. Implement 60 can be made with a small, medium, or large permanently attached thrust pad sized according to the body size of the potential user of the walking cane.

Operation of the Fifth Embodiment

Since no time should be wasted adjusting the length of the cane staff during a choking emergency, the staff length should be preset such that thrust pad 67 in the deployed position is just above the user's naval. Normally, pad 67 will be in the stored position. But, in a choking emergency, pulling on pull knob 70 instantly deploys thrust pad 67 to the deployed position. Then operation of implement 60 is similar to that of implement 14 except that cane handle 61 (or staff 65) is used to hold implement 60 during thrusting instead of cross handles.

Figure 12:
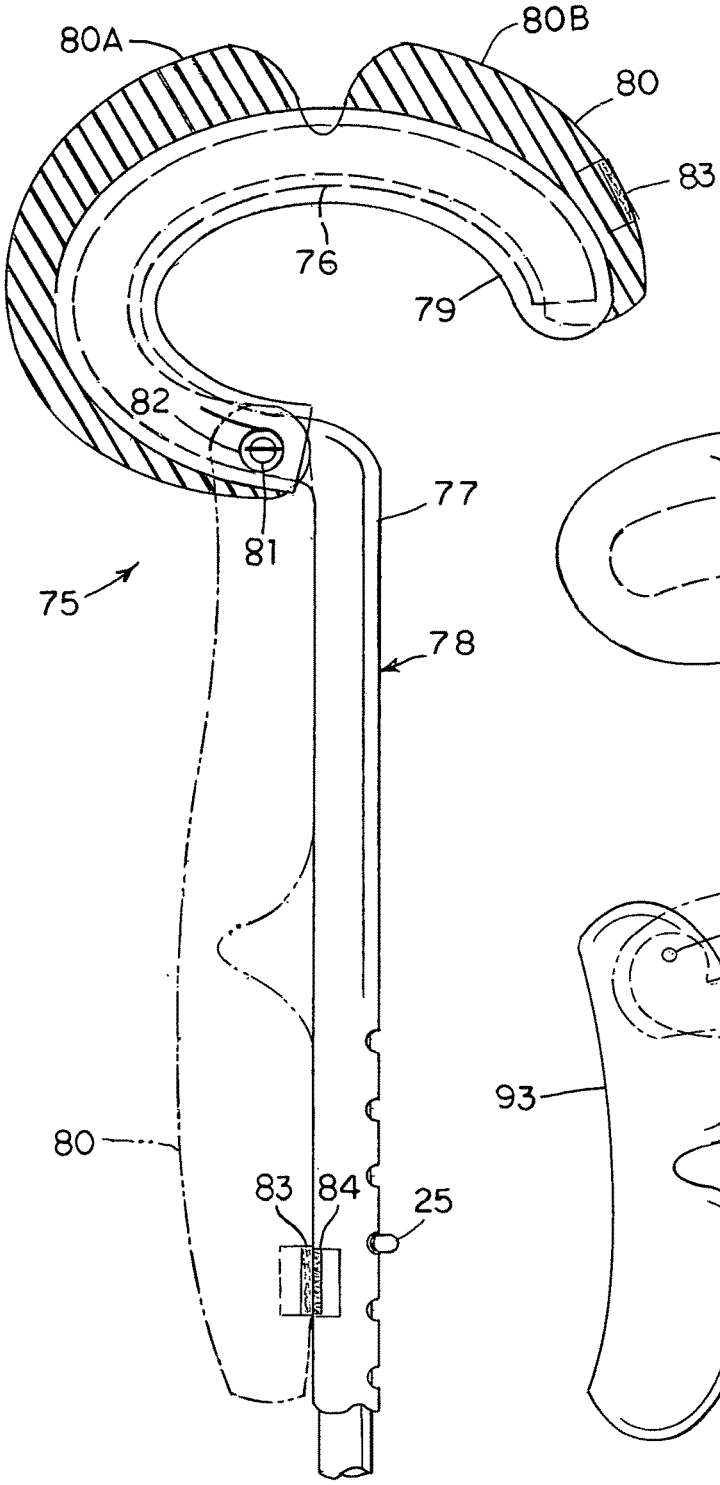
FIG. 12 is a lateral side view of a sixth embodiment or cane model B of an anti choking implement having a pivotally supported thrust pad shown in a deployed position and a stored position (phantom image) wherein the thrust pad in the deployed position is in section.
Figure 13:
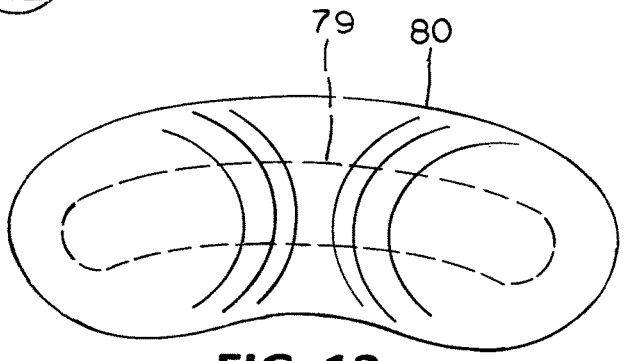
FIG. 13 is a top view of the thrust pad of FIG. 12.

Sixth Embodiment or Cane Model B—FIGS. 12 and 13

Some people prefer a walking cane having a crooked or curved handle. Therefore, FIGS. 12 and 13 show a sixth embodiment as a walking cane modal B designed to also function as an anti choking implement 75. This implement includes an aluminum handle 76 formed from an end portion of an aluminum tube 77 double-curved as indicated in the figures for conforming to the curvatures under the diaphragm. A linear portion of tube 77 forms the outer tube of a conventional multi-tubular telescoping length-adjustable cane staff 78. A conventional telescope locking means is provided including a lock button 25 as described for implement 14.

Handle 76 is padded by a foam cushion 79 for hand comfort when implement 75 is used simply as a walking cane. But in a choking emergency, padded handle 76 can function as a thrust pad for self-rescue of a small user such as a petite female. In addition, an elastomeric thrust pad 80 can pivot to cover cushion 79 for self-rescue of a larger choking user. Thrust pad 80 is molded to define an elongate open cavity such that pad 80 conforms and fits onto handle cushion 79 when pad 80 is in a deployed position. FIG. 12 shows that thrust pad 80 includes protuberances 80A and 80B spaced from each other and facing in approximately parallel directions. A fabric patch (not shown) is imbedded in the elastomer under the cleavage that divides the protuberances in order to strengthen the pad under the cleaved area. Thrust pad 80 is supported to pivot on a pivotal rivet 81 passing through apertures through pad 80 and through handle 76. Metal grommets 82 on each side of pad 80 surround rivet 81 to reinforce the pad. Rivet 81, grommets 82, and pad 80, pivot together. FIG. 13 shows a top view of thrust pad 80 when deployed.

Thrust pad 80 is resiliently flexible and can be stretched into a linear shape for being stored in a linear storage position (phantom image in FIG. 12). In the storage position, thrust pad 80 is secured to staff 78 by a loop fastener 83 fixed to pad 80. A strong hook fastener 84, mated to loop fastener 83, is fixed to staff 78 to grip loop fastener 83.

In a choking emergency, a larger than petite user need only flip pad 80 from the storage position to the deployed position which takes a fraction of a second. Then, cane model B can be used as described above for cane model A.

Figure 14:
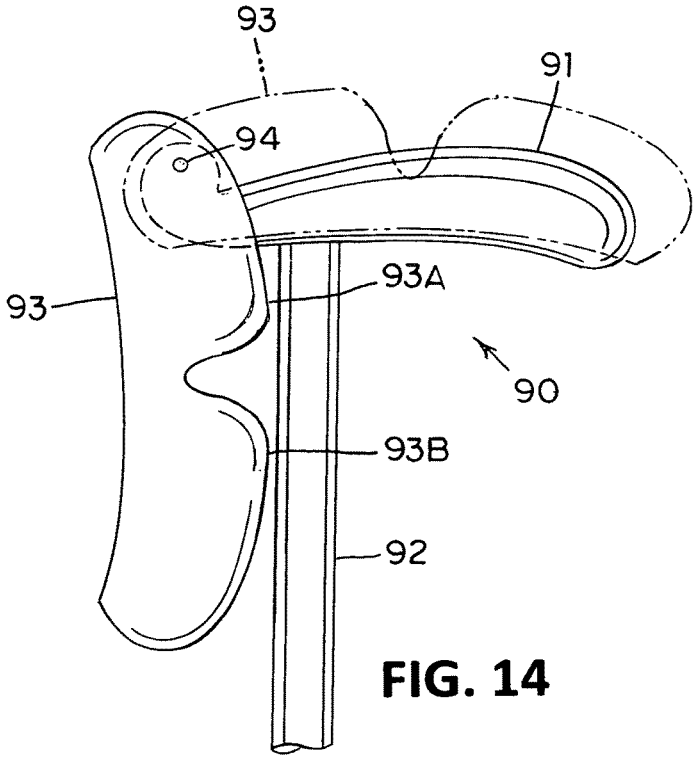
FIG. 14 is a lateral side view of a seventh embodiment or cane model C of an anti choking implement wherein a pivotally supported thrust pad is shown in stored and deployed positions.

Seventh Embodiment or Cane Model C—FIG. 14

A seventh embodiment or implement 90, shown in FIG. 14, is a variation of cane model B. Included is a rigid plastic cane handle 91 fixedly attached to a conventional multi-tube telescoping length-adjustable cane staff 92. A conventional locking means (not shown) is provided for locking the staff at a selectable length. A thrust pad 93, diaphragm-shaped as viewed axially of staff 92, is molded to define an elongate open cavity such that pad 93 can fit onto and cover handle 91 when pad 93 is in a deployed position. Thrust pad 93 includes protuberances 93A and 93B spaced from each other and facing in approximately parallel directions. Pad 93 is pivotally supported on a rivet 94 passing through apertures through pad 93 and through handle 91. A snug elastomeric fit of pad 93 to handle 91 in either a stored position or deployed position holds the pad in place until a user deliberately pivots the pad. As in all the cane embodiments, the thrust pads can be made available in a size suitable to the size of the potential user.

In a choking emergency, a user need only flip pad 93 from the storage position to the deployed position which takes a fraction of a second. Then, cane model C can be used as described above for cane model A. As in all of the cane embodiments, the thrust pad in the deployed position is located longitudinally beyond the staff and further therefrom than the handle. And as in all the cane embodiments, the thrust pad in the deployed position forms a top end portion of the respective cane sufficiently broad and convex to enable compression of a choking user's abdomen to rapidly expel lung gases and likely dislodge whatever causes choking.

Additional Uses and Applications:

1. During rest breaks on trekking trips, the length-adjustable trekking staff or cane implements can be reduced in vertical height. The elastomeric pad can be deployed and serve as a padded armrest or as a padded shoulder rest supporting upper body weight of a sitting user. The concave side of the thrust pad will fit comfortably against the lateral side of the user's chest under the user's shoulder for a restful break. All of the cane models with thrust pads can be used for arm or shoulder support in the same manner as the trekking staff implement.
2. Knee joint problems are very common among seniors. They will find it easier to stand after sitting when supported by one of the implements as described in the previous paragraph.
3. Anyone having an injured foot, ankle, or leg, can use the extended trekking staff with its thrust pad pack to function as a crutch.
4. The anti choking implements are useful tools for beach and pool life guards. Using one of the implements for doing abdominal thrusts on a reclined swimming accident victim that inhaled water is a way of clearing water from his or her lungs.

SCOPE AND CONCLUSION

All solid-food eaters and swimmers are at risk for accidental choking. The bilateral thrust pads of all of the embodiments include two protuberances spaced from each other and facing approximately in parallel directions. When the thrust pad engages the abdomen of a choking victim, the protuberances can be directed toward the victim's lungs, respectively. Both lungs can be efficiently compressed for clearing the victim's airway.

The self-rescue trekking staff and cane staffs provide anti-choking aids for walkers when dining at home or when dining away from home. The anti choking cane implements are especially handy for cane users because they tend to keep their canes close by. The thrust pad pack described for the trekking staff could alternatively be mounted on other handy telescoping household staffs such as the handle of a telescoping floor cleaning implement. Being at a higher risk for choking, elderly people including the Baby Boomers will be safer near an accessible self-rescue anti choking implement.

While the description above is of specific embodiments, these are not intended to be limited in scope to the embodiments shown and described, but rather as some useful examples. Each of these embodiments can give rise to various models and other embodiments. Combinations of features other than those shown can be contemplated. For example, features of the table models could be added to the trekking staff or cane embodiments or vice versa. Thus, the scope of the embodiments should be determined by the appended claims and their legal equivalents rather than by the examples given.

What is claimed is:

1. An anti choking implement for compressing a choking victim's abdomen in order to expel lung gases thereby dislodging whatever causes the choking, the implement comprising:

a thrust pad forming a pair of domed bilateral lobes, each dome having an open face that faces in a direction approximately parallel to that of the opposite dome; and at least one handle connected to said bilateral lobes for holding said bilateral lobes during bilateral compression of the choking victim's abdomen thereby causing rapid expulsion of gases from the victim's lungs to dislodge whatever causes the choking.

2. The anti choking implement as defined in claim 1 wherein at least one of the lobes being movably supported to be movable relative to the other lobe for aligning said lobes with a choking victim's lungs, respectively.

3. The anti choking implement as defined in claim 2 further comprising a calibrated scale for adjusting the spatial distance between the lobes according to the chest size of a potential choking victim.

4. The anti choking implement as defined in claim 1 wherein at least one of said lobes being movably supported by a telescopically adjustable support for telescopically adjusting the distance between said lobes to align said lobes with the victim's lungs, respectively.

5. The anti choking implement as defined in claim 1 further comprising each lobe being capped by a domed detachable cap, said domed detachable cap being larger than the domed portion of the lobe.

6. The anti choking implement as defined in claim 5 further comprising each detachable cap being capped by a domed detachable larger cap, said domed detachable larger cap being larger than the detachable cap being capped.

7. The anti choking implement as defined in claim 1 further comprising a base supporting the thrust pad lobes tilted a few degrees away from facing in a vertical direction thereby facilitating engagement of the lobes with the abdomen of a choking victim.

8. An anti choking implement for compressing a choking victim's abdomen in order to expel lung gases thereby dislodging whatever causes the choking, the implement comprising:

a thrust pad having a pair of spaced pad protuberances for compressing the victim's two lungs, respectively;

a telescopically adjustable support movably supporting at least one of said protuberances for telescopically adjusting the distance between said protuberances to align said protuberances with the victim's lungs, respectively; and at least one handle connected to said protuberances for holding said protuberances during compression of the choking victim's lungs.

9. The anti choking implement as defined in claim 8 wherein of each protuberance in a top view thereof having a flat side facing the other protuberance and each protuberance being otherwise mostly rounded.

10. The anti choking implement as defined in claim 8 further comprising said implement including a calibrated scale for adjusting the spatial distance between protuberances according to chest size of a potential choking victim.

11. The anti choking implement as defined in claim 8 further comprising each protuberance being capped by a detachable cap, said cap being larger than the protuberance.

12. The anti choking implement as defined in claim 11 wherein said detachable cap being mostly elastomeric.

13. The anti choking implement as defined in claim 11 further comprising each detachable cap being capped by a detachable larger cap, said detachable larger cap being larger than the detachable cap being capped.

14. The anti choking implement as defined in claim 13 wherein said detachable larger cap being mostly elastomeric.

15. A method of rescuing a choking victim by abdominal thrusting, the method comprising the steps:

(a) providing a pair of spaced open-faced domes and facing the face of each dome in a direction approximately parallel to that of the other dome;

(b) engaging the domes bilaterally against the victim's abdomen and in alignment with the victim's lungs, respectively; and (c) thrusting the domes toward the victim's two lungs, respectively, to rapidly expel gases from the victim's lungs to dislodge whatever is causing the choking.

* * * * *